United States Patent [19]

Surtees

[11] Patent Number: 4,915,824

[45] Date of Patent: Apr. 10, 1990

[54] PNEUMATIC CLASSIFIER FOR TOBACCO AND METHOD

[76] Inventor: Guy F. Surtees, P.O. Box 466, Wilson, N.C. 27894

[21] Appl. No.: 128,710

[22] Filed: Dec. 4, 1987

Related U.S. Application Data

[63] Continuation of Ser. No. 764,486, Aug. 12, 1985, abandoned.

[51] Int. Cl.[4] ..... B07B 4/02; B07B 11/02

[52] U.S. Cl. ..... 209/139.1; 209/137; 209/153; 209/154

[58] Field of Search ..... 209/12, 44.1, 133, 136, 209/137, 138, 139.1, 153, 154, 629, 631, 638, 639, 641, 642; 131/109.2, 110, 306, 312, 314

[56] References Cited

U.S. PATENT DOCUMENTS

| | | | |
|---|---|---|---|
| 518,082 | 4/1894 | Stuckey et al. . | |
| 974,395 | 11/1910 | Kidder | 209/642 X |
| 1,530,277 | 3/1925 | Mettler, Sr. | 209/137 |
| 1,863,666 | 6/1932 | Lorentz . | |
| 1,903,931 | 4/1933 | Molins et al. . | |
| 1,962,668 | 6/1934 | Olney | 209/136 |
| 2,130,880 | 9/1938 | Durning . | |
| 2,173,088 | 9/1939 | Eissmann . | |
| 2,275,849 | 3/1942 | Fraser | 209/466 |
| 2,658,617 | 11/1953 | Rowell . | |
| 2,667,174 | 1/1954 | Eissmann . | |
| 2,825,457 | 3/1958 | Rowell . | |
| 2,852,137 | 9/1958 | Hagopian . | |
| 2,941,667 | 6/1960 | Hilgartner, Jr. et al. . | |
| 2,944,629 | 7/1960 | Eissmann . | |
| 2,988,213 | 6/1961 | Davis et al. . | |
| 3,010,576 | 11/1961 | Harte et al. . | |
| 3,034,646 | 5/1962 | Eissmann et al. . | |
| 3,074,413 | 1/1963 | McArthur . | |
| 3,092,117 | 6/1963 | Labbe . | |
| 3,164,548 | 1/1965 | Rowell et al. | 209/153 X |
| 3,200,947 | 8/1965 | Wochnowski . | |
| 3,240,335 | 3/1966 | Vandenhoeck | 209/154 X |
| 3,265,209 | 8/1966 | Wochnowski et al. . | |
| 3,308,950 | 3/1967 | Harte et al. . | |
| 3,360,125 | 12/1967 | Horsey . | |
| 3,362,414 | 1/1968 | Wochnowski . | |
| 3,378,140 | 4/1968 | Wochnowski et al. | 209/137 |

(List continued on next page.)

FOREIGN PATENT DOCUMENTS

| | | | |
|---|---|---|---|
| 0483698 | 11/1974 | Australia | 209/139.1 |
| 0630756 | 6/1936 | Fed. Rep. of Germany | 209/137 |
| 0828904 | 6/1938 | France | 209/137 |
| 0047566 | 1/1940 | Netherlands | 209/137 |
| 746106 | 3/1956 | United Kingdom . | |
| 0755252 | 8/1956 | United Kingdom | 209/138 |
| 1167866 | 10/1969 | United Kingdom | 209/136 |

OTHER PUBLICATIONS

"Single-Pass Classifier Reduces Leaf Degradation", *Tobacco Reporter*, Apr. 1985.

*Primary Examiner*—Johnny D. Cherry
*Assistant Examiner*—Edward M. Wacyra
*Attorney, Agent, or Firm*—Wood, Herron & Evans

[57] ABSTRACT

Intermixed light leaf and heavy stem tobacco particles are fed or propelled inwardly and across a vertical separator chamber of the classifier while forced air is directed upwardly through the intermixed particles and at varying velocities across the length of the separator chamber to gently separate the leaf particles from the heavier stem particles. The stream of intermixed particles is projected across the separator chamber at a variable initial velocity and the varying velocities of the upwardly directed forced air streams are correlated with the velocity of the stream of particles being fed across the separator chamber to gently separate the light leaf particles from the heavier stem particles. An adjustable deflector plate is supported adjacent the inlet feed for varying the angular position of the feeding of the stream of intermixed particles across the separator chamber to thereby vary the classifying plane in which the particles are projected across the separator chamber. A set of air pattern screens, with openings of different sizes therein, is provided for easy insertion and removal of the individual air pattern screens in the separator chamber to control the amount of forced air which passes upwardly through the separator chamber.

34 Claims, 3 Drawing Sheets

U.S. PATENT DOCUMENTS

| | | | |
|---|---|---|---|
| 3,397,782 | 8/1968 | Kwong et al. . | |
| 3,443,688 | 5/1969 | Molins . | |
| 3,542,037 | 11/1970 | Pietralunga . | |
| 3,593,851 | 7/1971 | Davidson . | |
| 3,608,716 | 9/1971 | Rowell et al. | 209/153 X |
| 3,655,043 | 4/1972 | Wochnowksi et al. | 209/153 X |
| 3,727,755 | 4/1973 | Cristiani . | |
| 3,986,949 | 10/1976 | Di duca et al. . | |
| 4,003,385 | 1/1977 | Adebahr et al. . | |
| 4,045,334 | 8/1977 | Ferrary et al. | 209/154 X |
| 4,213,852 | 7/1980 | Etkin | 209/136 |
| 4,253,940 | 3/1981 | Price . | |
| 4,405,451 | 9/1983 | Roman | 209/136 |
| 4,411,038 | 10/1983 | Mukai | 209/466 X |
| 4,465,194 | 8/1984 | Coleman | 209/639 |
| 4,475,562 | 10/1984 | Thatcher et al. | 209/136 X |
| 4,618,415 | 10/1986 | Vecchio et al. | 209/154 X |
| 4,701,256 | 10/1987 | Cross . | |
| 4,755,284 | 7/1988 | Brooks et al. | 209/154 X |

10/1969

PNEUMATIC CLASSIFIER FOR TOBACCO AND METHOD

This is a continuation of application Ser. No. 764,486, filed Aug. 12, 1985 now abandoned.

FIELD OF THE INVENTION

This invention relates generally to a pneumatic classifier for tobacco and to a method for separating light tobacco leaf particles from heavier stem particles, and more particularly to such a classified and method in which the intermixed leaf and stem particles are fed inwardly and across a vertical separator chamber while forced air is directed upwardly through the intermixed particles and at varying velocities across the length of the separator chamber to gently separate the leaf particles from the heavier stem particles.

BACKGROUND OF THE INVENTION

It is generally known to provide a pneumatic classifier for separating light tobacco leaf particles from heavier stem particles. For example, one such device is disclosed in the Rowell et al U.S. Pat. No. 3,164,548 in which the intermixed light and heavy tobacco particles are projected into and across the separating chamber while forced air is directed upwardly through the particles and at a uniform velocity across the length of the separating chamber. The lighter leaf particles are blown upwardly while the heavier stem particles fall downwardly and onto a vibrating screen positioned at an inclined angle so that the heavier particles are discharged in a location adjacent the end of the separator chamber containing the inlet for the intermixed leaf and stem particles. It has been found that the classifier of this patent cannot be efficiently utilized in the earlier stages of the separation of threshed tobacco leaves because the leaf particles and stem particles tend to form tangled balls or matts, usually referred to as "bird nests," within the separator chamber.

These bird nests are formed because the intermixed light and heavy particles tend to attach themselves together and the resulting bird nests are light enough to be carried upwardly by the upwardly moving forced air in the separating chamber so that some heavy stem particles are carried upwardly and removed with the lighter leaf particles. In other instances, the bird nests are of sufficient weight that they drop to the lower portion of the separator chamber and carry some of the lighter leaf products out the stem discharge outlet and to the next processing stage. In any case, the formation of bird nests is undesirable because they interfere with the efficient separation of the particles in the separator chamber, and they also tend to block or clog the stem outlet passageway and they disburb smooth flow of process.

U.S. Pat. No. 3,608,716, issued to Lorne A. Rowell, also discloses a similar type of pneumatic classifier for tobacco including an endless foraminous conveyor belt extending across the lower portion of the separator chamber for removing the heavier stem particles. This patent also discloses a recirculating arrangement in which an air jet is positioned in the wall opposite the material inlet wall to again force the particles across the chamber and subject the particles to the upflowing air and thereby provide a second stage of separation. This second stage of separation is said to aid in preventing the formation of bird nests. However, it has been found that the moving conveyor belt in the separator chamber requires maintenance and periodic replacement at substantial cost. Also, the recirculating of the particles in the second stage of separation casuses degradation of the lighter leaf particles.

SUMMARY OF THE INVENTION

With the foregoing in mind, it is an object of the present invention to provide a pneumatic classifier in which the velocity of the upwardly flowing forced air is varied across the length of the separator chamber and the varied velocity of the forced air is coordinated with the velocity of the stream of intermixed leaf and stem particles propelled into and across the separator chamber to provide a gentle separation of the leaf particles from the stem particles and to reduce degradation of the leaf or lamina particles.

In accordance with the present invention, the upward flow of forced air in the separator chamber passes through the intermingled light leaf particles and heavier stem particles a single time only and the heavier stem particles are discharged on the lower portion and at the opposite end of the separator chamber from the end on which the particles are introduced into the separator chamber so that the heavier stem particles do not again pass through the upwardly flowing forced air as the heavier stem particles move to the discharge passageway. The classifier of the present invention also eliminates the usual moving parts, such as vibrating screens and conveyor belts, normally positioned inside of the separator chamber thereby minimizing the time which is spent in cleaning and maintaining the present classifier. The usual type of conveyor belts are expensive to produce and replace.

The present pneumatic classifier includes a vertically extending separator chamber with a material inlet feed on one side of the separator chamber for feeding a stream of intermixed light tobacco leaf particles and heavier stem particles into and across the separator chamber at a predetermined initial velocity and with the velocity of the stream of intermixed leaf and stem particles decreasing as they travel from the inlet feed and toward the opposite end of the separator chamber. A forced air inlet is provided in thelower end of the separator chamber for directing a stream of forced air into the lower inlet of the separator chamber at a predetermined velocity.

Air distribution means is provided between the forced air inlet and the stream of leaf and stem particles for separating the inlet air stream into at least high, medium and low velocity streams and for also directing the separated air streams in an upward flow through the separator chamber with the high velocity air stream moving upwardly adjacent the end of the separator chamber into which the particles are introduced so that the high velocity upwardly flowing air passes through the intermingled leaf and stem particles immediately after entering the separator chamber and while traveling at their greatest velocity. The medium velocity air stream moves upwardly in the central portion of the separator chamber and passes through the medial portion of the stream of leaf and stem particles while they are traveling at an intermediate velocity and after a considerable number of the leaf particles have been intially separated from the stream. The low velocity air stream moves upwardly adjacent the other end of the separator chamber and passes through the stem and any remaining leaf particles as they approach the other end of the separation chamber. The stem removal outlet is positioned in the lower portion of the other end of the separator chamber so that the heavier stem particles are directly projected into the stem or "heavies" outlet.

The air distribution means includes adjustable means in the form of air transfer deflector plates or baffles and air diffuser guides extending from a position upstream of the air inlet and into the lower portion of the separation chamber. The adjustable deflector baffles and the diffuser guides operate to divert and spread the inlet forced air into the three air streams of varying velocity across the width of the separator chamber.

The air distribution means also includes sets of plenum screens extending across the lower portion of the separator chamber and above the diffuser guides. Each set of the plenum screens is provided with openings of different sizes to aid in controlling the velocity and distribution of the upwardly flowing forced air stream, in accordance with the type of tobacco particles being fed into the separation chamber. A set of plenum screens with different size openings can be easily inserted into the separator chamber to adapt the classifier for any particular position in the various stages of separation in a plant where a large number of classifiers may be operating in a complete threshing line. The plenum screen is supported at an inclined angle toward the stem outlet for directing any stem particles or fines deposited thereon toward the stem outlet. The upwardly flowing forced air passing through the plenum screen has a tendency to lift the stem particles and fines and thereby aids in the same along the surface of the plenum screen and into the stem outlet.

An adjustable deflector plate is positioned at the inlet for the intermixed or intermingled leaf and stem particles and is operable to adjust the angle of trajectory of the particles entering and being propelled across the separator chamber. This adjustable deflector plate also aids in obtaining the most efficient separation of the leaf and stem particles as they travel from the inlet feed and toward the opposite end of the separator chamber.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
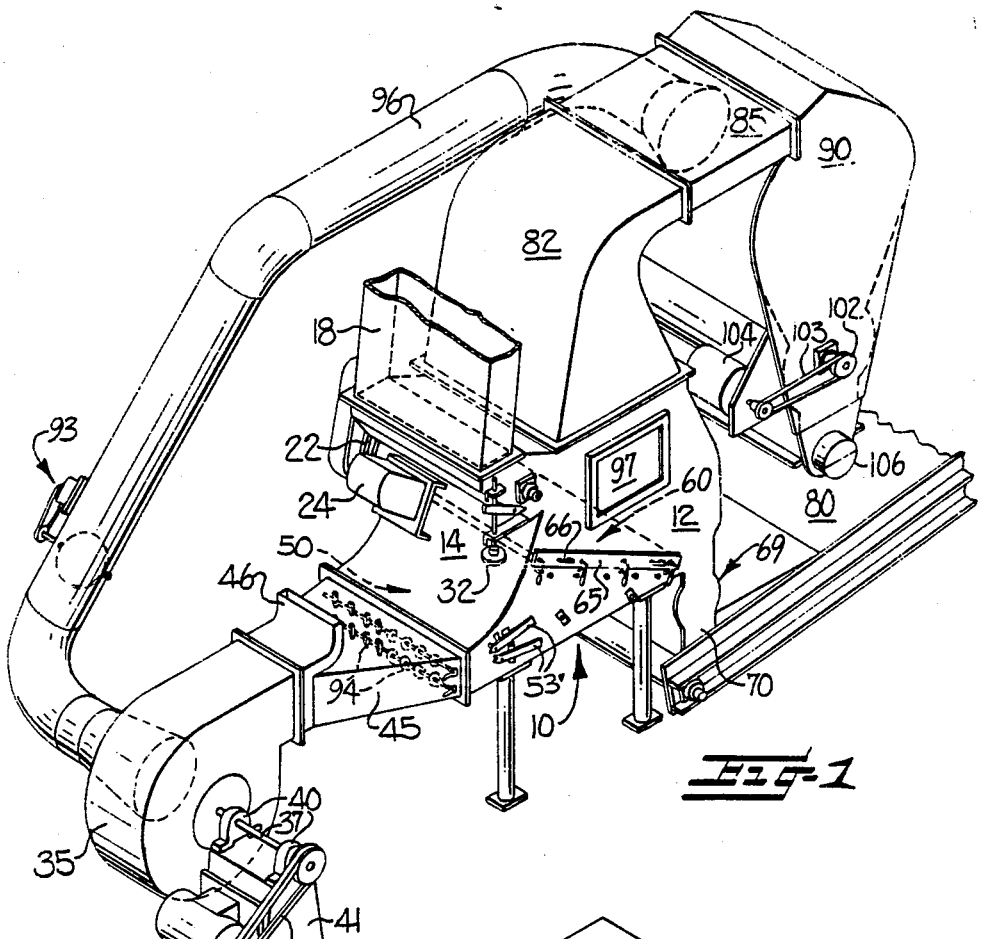
FIG. 1 is an isometric view of one side of the classifier of the present invention.

The pneumatic classifier illustrated in the drawings may be successfully operated in any one of the stages of separating the lighter leaf particles from the heavier stem particles throughout the entire threshing line of classifiers. The velocity of the separating air throughout the length of the separator chamber is varied and coordinated with the velocity of the stream of intermixed leaf and stem particles as they are propelled across the separator chamber to thereby provide a gentle separation of the lighter leaf particles from the heavier stem particles. The present classifier may be termed a "single pass" system because lighter leaf particles and the heavier stem particles are engaged by the upwardly flowing forced air only one time in the separator chamber.

Figure 4:
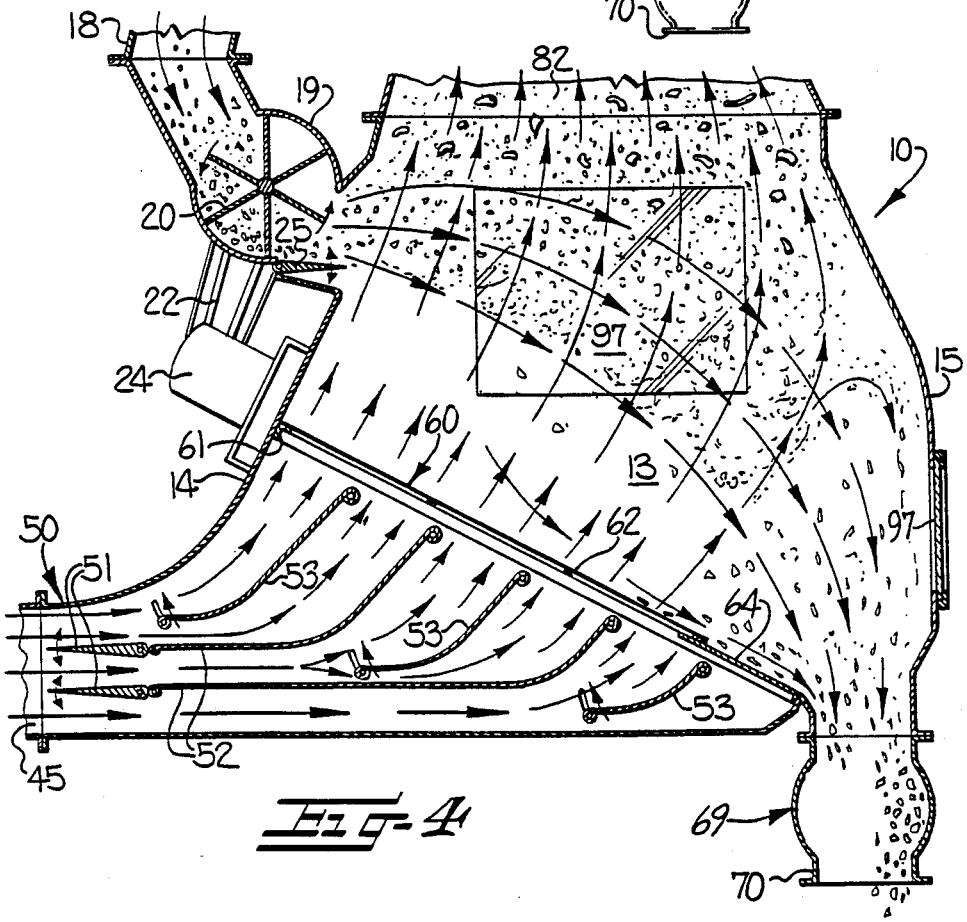
FIG. 4 is an enlarged vertical sectional view through the separator chamber of the classifier.

As illustrated in the drawings, the present pneumatic classifier includes a vertically extending separator chamber defined by a main housing, broadly indicated at 10, and including substantially vertical opposite side walls 12, 13 connected together by respective inlet and outlet walls 14, 15 with their upper ends converging toward each other, as best shown in FIG. 4. Material inlet feed means communicates with the inlet side wall 14 and includes a substantially vertically extending inlet chute 18 for receiving the intermixed or intermingled leaf and stem particles from any suitable type of conveyor, now shown. The inlet chute 18 directs the intermixed particles downwardly into an inlet rotor housing 19 in which a vaned rotor 20 is supported for rotation in a cylindrical portion thereof. One end of the drive shaft of the rotor 20 is provided with a drive pulley 21 (FIG. 5) engaged by a drive belt 22 which is in turn drivingly engaged by an output drive pulley 23 of a variable speed electric motor 24 for imparting counterclockwise rotation to the rotor 20, as illustrated in FIG. 4.

Figure 3:
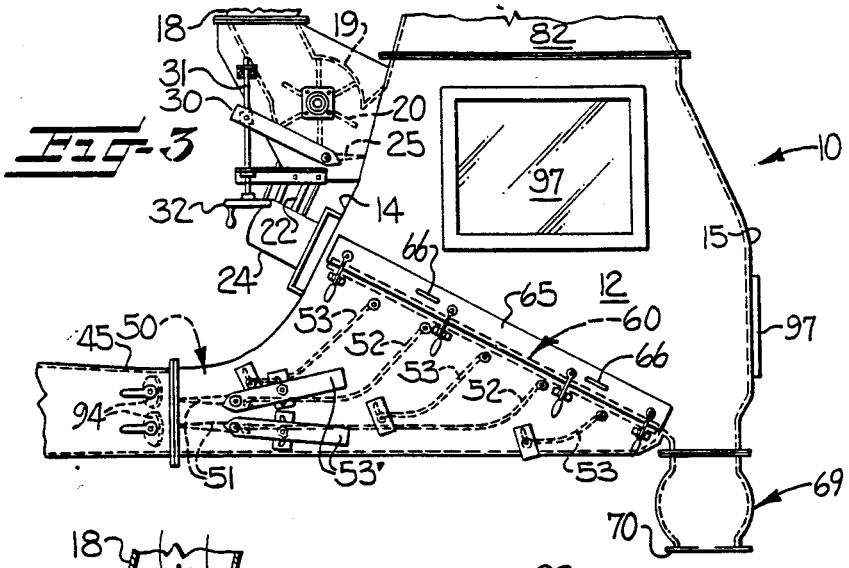
FIG. 3 is fragmentary side elevational view of the central portion of FIG. 1.

An adjustable deflector plate 25 is supported adjacent the discharge position of the rotor 20 for varying the path of movement of the particles projected across the separator chamber, as indicated by the arrows in FIG. 4 In order to raise or lower the inner portion of the deflector plate 25 to the desired adjusted position, the outer end portion of the deflector plate 25 is fixed on a control shaft which extends outwardly through the rotor housing 19 and is fixed to the inner end portion of angularly disposed control lever 30 (FIG. 3). A threaded bushing is connected to the outer end of the control lever 30 and is threadably penetrated by an elongate adjustment screw 31 which is supported in a vertical position at its upper and lower ends. A rotating hand wheel 32 is fixed to the lower end of the adjustment screw 31 for rotating the same. By selectively rotating the hand wheel 32, the adjustment screw 31 either raises or lowers the outer end of the control lever 30 correspondingly lowers or raises the inner end of the deflector plate 25.

The rotor 20 initially feeds the stream of intermingled leaf and stem particles into the inlet side of the separator chamber at a predetermined velocity, which is determined by the speed of the variable speed motor 24 and the speed of rotation of the rotor 20. The input velocity of the stream of intermingled leaf and stem particles decreases as the particles travel from the inlet feed side and toward the opposite end wall 15 of the separator chamber. The deflector plate 25 serves two primary functions and it is adjusted, according to the characteristics of the tobacco particles being fed by the rotor 20, to vary the angle at which the particles are projected across the separation chamber so as to change the cross-sectional area of the classifying plane by either passing the particles along a higher or lower velocity stream without necessarily having to make any adjustment of the velocity of the upwardly flowing forced air. Also, the deflector plate can be adjusted to direct the stem particles more directly into the discharge chute, to be presently described, and to thereby aid in preventing a choke-up of the discharge chute.

Forced air inlet supply means is provided in the lower end of the separator chamber for directing a steam of forced air into the lower end of the inlet end of the separator chamber at a predetermined velocity. The forced air inlet supply means includes a substantially cylindrical housing 35 (FIG. 5) in which a fan blower 36 is supported for rotation. A drive shaft 37 of the fan blower 36 extends outwardly through one side of the housing 35 and is rotatably supported on bearing blocks 40 fixed on a motor support stand 41 (FIG. 1). An electric drive motor 42 is fixed on the stand 41 and is drivingly connected to the drive shaft 37 by means of drive pulleys and a drive belt 43. An air duct 45 connects the cylindrical housing 35 with the inlet end of the separator chamber 10 and includes an upwardly turned air bleed-off duct 46.

As illustrated in FIG. 4, a forced air inlet, broadly indicated at 50, is provided in the lower left-hand portion of the separator chamber 10 and includes air distribution control means positioned between the forced air inlet 50 and the stream of leaf and stem particles being directed across the separator chamber by the rotor 20. The air distribution includes air diffuser guides 94 which help spread the air volume across the separator which help spread the air volume across the separator chamber and comprise in the present preferred embodiment four rotatably mounted rods perpendicular to and in the airstream and mounting a plurality of circular air diffuser plates (best illustrated in FIG. 1). The air distribution means also includes a pair of air transfer deflectors 51 including vertically adjustable leading or upstream ends, as indicated by the arrows in FIG. 4. The deflectors 51 divide the incoming forced air into three separate air streams, the velocity of each of which may be varied according to the positions of the air transfer deflectors 51. The trailing or downstream ends of the air transfer control means or deflectors 51 are fixed on control shafts which extend outwardly through the housing (FIG. 3) and are fixed to the ends of corresponding control levers 53'. The other ends of the control levers 53' may be raised and lowered to thereby change the angle of the deflectors 51. The deflectors 51 are maintained in the adjusted position by suitable locking means, illustrated in FIG. 3 in the form of lock bolts extending through slotted brackets fixed on the side wall 12.

The air distribution means also includes means for directing the separated air streams upwardly and along different upwardly flowing paths of travel across the width of the separator chamber 10. The air directing means includes air transfer control means in the form of a pair of fixed air diffuser guides 52 which have their upstream ends fixed in alignment with trailing the ends of the air transfer deflectors 51 and their downstream ends are fixed in positions spaced across the path of movement of the forced air into the lower section of the separator chamber 10. Adjustable air transfer control means in the form of air diffuser vanes 53 have their upstream ends supported for adjustment across the width of the corresponding air passageways provided by the fixed air diffuser guides 52, as indicated by the arrows in FIG. 4. The downstream ends of the adjustable air diffuser vanes 53 are fixed in substantially equidistant relationship between and substantially dividing the separate air velocity chambers formed by the side walls and the fixed air diffuser guides 52.

Figure 2:
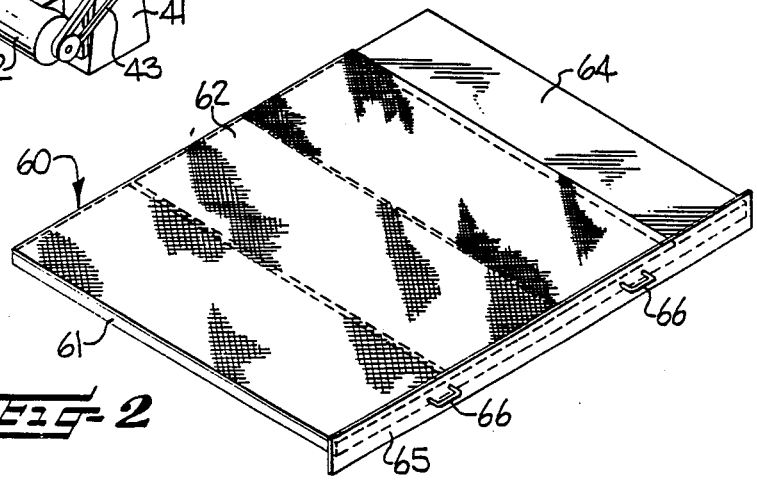
FIG. 2 is an enlarged isometric view of a separator screen of the type utilized in the separation chamber, being removed from the classifier.

An air pattern screen, broadly indicated at 60, (FIG. 2) extends across the lower portion of the separator chamber 10 (FIG. 4) at an angle of approximately 30° and substantially perpendicular to the flow of the separate streams of forced air entering the lower end of the separator chamber 10. The air pattern screen 60 is positioned imediately adjacent the downstream ends of the fixed diffuser guides 52 and the adjustable air diffuser vanes 53. The screen 60 (FIG. 2) is provided with a frame 61 supporting a screen section 62 and a solid section 64. A slot is provided in the side wall 12 so that the air pattern screen 60 may be easily removed and inserted therein. One side edge of the frame 61 is provided with a closure plate 65 having handles 66 and the screen 60 is maintained in position by stop closures engaging the closure plate 65. A set of the screens 60 is provided with each classifier and the size of the mesh or openings of each screen of the set is varied. Also, mesh size can be varied across each plenum screen in the set to vary the air flow across the length of the separator chamber 10. Thus, a screen with the proper size mesh or openings can be inserted in the separator chamber 10 to contol the distribution of air flowing therethrough, for purposes to be presently described.

As shown in FIG. 4, stem removal means, broadly indicated at 69, is provided in the lower portion and on the opposite end of the separator chamber 10 from the inlet feed rotor 20. The stem removal means 69 includes a discharge outlet chute 70 communicating with the outlet in the lower left-hand portion of the separator chamber 10 and positioned immediately adjacent the lower end of the air pattern screen 60 (FIG. 4). An optional outlet rotor (not shown) may be supported for rotation in the housing 70. A stem discharge conveyor belt 80 is positioned beneath the lower end of the stem outlet and is driven by a suitble motor, not shown, to remove the separated stem particles to a suitable location away from the classifier.

A leaf particle removal duct 82 is provided on the upper end of the separator chamber 10 and has inwardly tapered forward and rear walls, and a rearwardly curving and horizontal portion connected to the forward end of a rectangular leaf particle transport duct 85. The rear end of the duct 85 is connected to the inlet of a tangential separator housing 90 which forms part of a centrifugal type discharge unit.

If desired, the central portion of the tangential separator housing 90 may be provided with a cylindrical screen, not shown, to prevent the discharge of any light leaf products through the outlet of the fan blower and into a cylindrical return air duct 96. The cylindrical return air duct 96 is connected to the inlet side of the air inlet fan blower housing 35, as illustrated in FIG. 1 so that the air utilized in the separation operation is recycled. The air volume is controlled by an adjustable damper, shown generally at 94.

Figure 5:
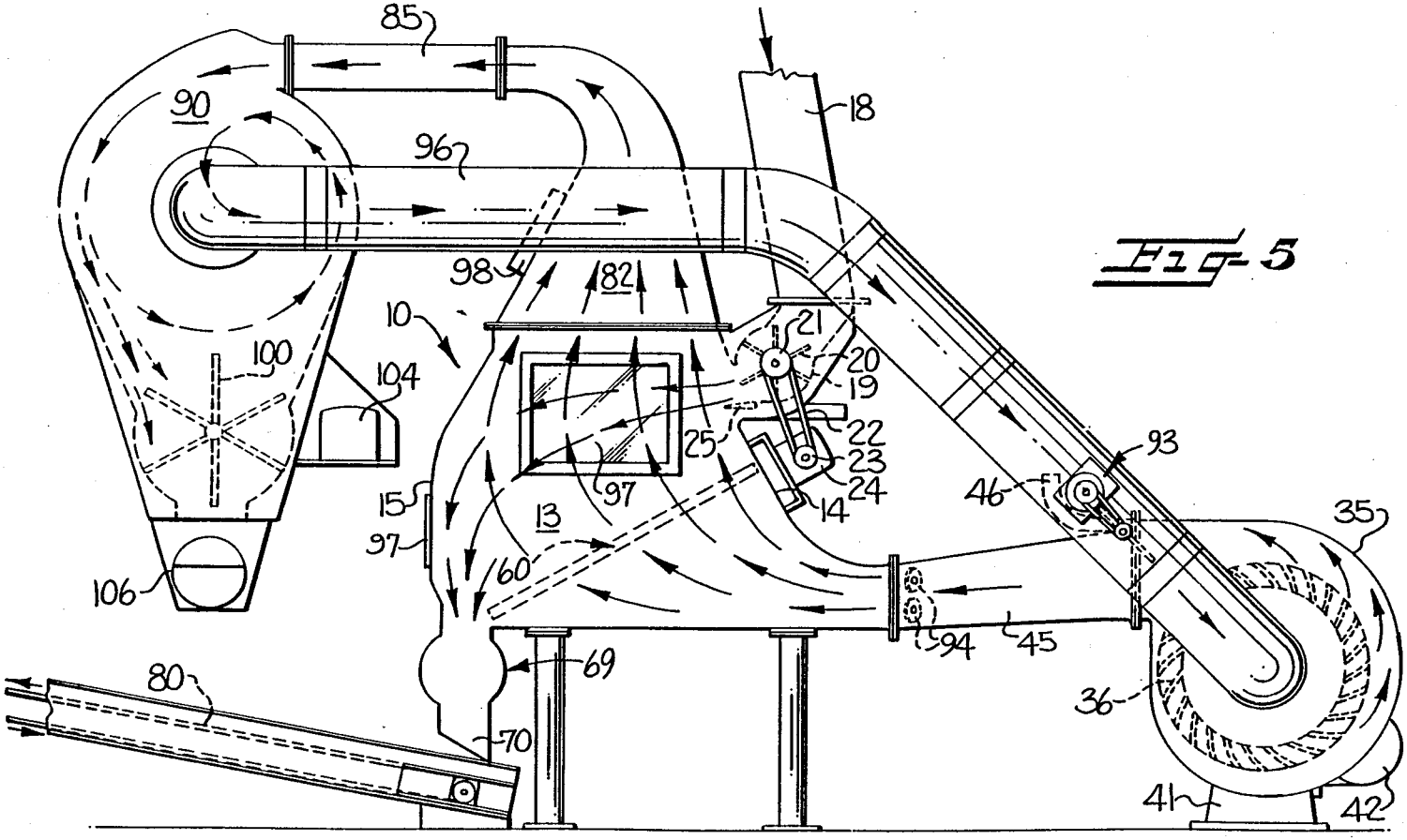
FIG. 5 is a side elevational view of the opposite side of the classifier from that shown in FIG. 1.

In order to be able to easily observe the operation in the separation chamber, it is preferred that the opposite side walls 12, 13 and the outlet wall 15 of the separation chamber be provided with windows, as illustrated at 97 in FIGS. 1, 3 and 5. It is also preferred that a suitable fluorescent light support chamber 98 be provided in the removal duct 82 to illuminate the upper portion of the separator chamber 10 so that the separation operation can be easily viewed through the windows 97 and proper adjustments can be made in the air velocity and/or the input rotor 20.

As the light leaf particles are separated from the return air in the tangential separator housing 90, they fall downwardly into a leaf output air-lock 100 (FIG. 5)

supported for rotation in the lower portion of the tangential separator housing 90. The output rotor 100 is provided with a drive shaft which extends outwardly beyond the side of the housing 90 (FIG. 1) and is provided with a drive pulley 102. A drive belt 103 drivingly connects the drive pulley 102 and to the drive pulley of a variable speed drive motor 104. Any suitable type of conveying mechanism or removal system may be employed to transport the separated light leaf particles from the output rotor 100 of the classifier. FIGS. 1 and 5 illustrate a tubular collection device 106 which may be suitably connected to a pneumatic conveying duct for removing the separated light leaf particles.

Method of Operation

The incoming intermingled light leaf and heavier stem particles are engaged by the rotor 20 and a stream of the intermixed particles is propelled into and across the separator chamber 10, as illustrated by the arrows in FIG. 4, and at a predetermined velocity. The initial velocity of the particles, as they enter the separator chamber, may be varied by adjusting the speed of the variable speed motor 24. The initial velocity of the particles entering the separator chamber 10 is varied in accordance with the type of particles being fed into the separator chamber, this usual velocity is within the range of about 1,000 to 1,200 feet per minute. The velocity of the stream of intermingled leaf and stem particles gradually decreases as the particles travel from the inlet feed to the opposite end of the separator chamber 10.

The angular position of the deflector plate 25 is adjusted to obtain the desired cross-sectional area of the classifying plane. The deflector plate 25 may be adjusted so that the heavier stem particles are projected in a smooth, substantially horizontal curving arc almost directly into the discharge chute 70. The deflector plate 25 may be adjusted so that the heavier stem particles are projected against the substantially smoothly curved surface of the outlet wall 15 so that they fall downwardly into the discharge chute 70. As the intermixed particles pass along the classifying plane and across the separator chamber 10, they are engaged by the upwardly flowing forced air currents, rents, as indicated by the arrows in FIG. 4, so that the lighter leaf particles are gently separated from the heavier stem particles and carried upwardly through the removal duct 82 and into the tangential separator housing 90.

The air distribution means at the forced air inlet 50 of the separator chamber 10 is adjusted to provide the most efficient separation of the light leaf particles from the heavy stem particles in the separation chamber. The incoming forced air is controlled to provide air streams of varying velocities across the length of the separator chamber 10 and the velocities of the separating air are coordinated with and adjusted in proportion to the decreasing velocity of the particles as they move across the length of the chamber 10 so that the lighter leaf portions are "peeled" off from the stem particles and moved in an upward direction almost immediately after entering the separator chamber 10.

The air transfer deflectors 51 and the air diffuser guides 52 are adjusted to provide a higher velocity air stream on the rotor or input side of the separator chamber 10. The air stream entering between the transfer deflector 51 and directed by the air diffuser guides 52 and 53 into the medial or central portion of the separator chamber 10 travels at a medium velocity, somewhat less than the velocity of the upwardly flowing air stream adjacent the inlet rotor 20. The air stream entering below the lower transfer deflector 51 and directed into the discharge side of the separator chamber 10 by the diffuser guides 52, 53 is partially blocked by the solid portion 64 of the screen 60 and travels upwardly along the outlet side of the separator chamber 10 at a lower velocity than the other two air streams. The velocity of each of the air streams is correlated with the decreasing velocity of the particles passing across the separator chamber 10 to obtain the most efficient separation.

The velocity of the upwardly flowing air streams in the separator chamber 10 is usually on the order of from about 600 to 800 feet per minute, depending upon the type of tobacco product which is being separated. As a specific but nonlimiting example, it has been found that efficient separation takes place when the air stream entering above the deflector 51 and directed into the area immediately adjacent the input impeller 20 is controlled at a velocity of about 800 feet per minute. The air stream entering between the two transfer deflectors 51 and guided into the central portion of the air separator chamber 10 is controlled at a velocity of about 450 feet per minute. The air stream entering below the lower deflector 51 and being directed into the outlet side of the air chamber 10 is controlled at a velocity of about 200 feet per minute.

Air pattern screen 60 can be used to change the distribution of air flowing through the stream of particles. A screen 60 with large openings can be inserted to increase the volume of air, and a screen 60 with smaller openings can be inserted to decrease the volume of air. Thus, flow characteristics of the forced air within the separator chamber 10 can be varied by simply changing the type of air pattern screen 60 being utlized. These air pattern screens 60 can be exchanged in a few seconds so that the present classifier can be effectively used in any stage of an entire threshing line.

In the present classifier, there are no moving parts in the air separator chamber and the separating air passes through the incoming stream of tobacco particles at a velocity which is in substantial proportion to and correlated with the velocity of the particles passing across the separator chamber. This control of the separating air provides a gentle and smooth separation of the light leaf particles from the heavy stem particles and ensures that the separation takes place without degrading the leaf particles. To reduce the exhausting of fines and other small particles into the atmosphere surrounding the classifier, it is preferred that a slight negative pressure be maintained in the pneumatic circuit of the classifier.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A vertical lift pneumatic classifier for separating light tobacco leaf particles from heavier tobacco stem particles, and being characterized by a single pass of tobacco particles across a separation chamber, and being adjustable for use with a full range of fed tobacco particle sizes and shapes in a threshing system, said classifier comprising:

a vertically extending separator chamber;

tobacco particle feed means located at a first end of said separator chamber for projecting a dispersing stream of intermixed light leaf and heavier stem particles across said separator chamber from one end thereof toward another in an unrestricted path;

leaf removal means disposed proximate an upper portion of said separator chamber;

stem removal means located at a second opposite end of said separator chamber, opposite said tobacco particle feed means, and at an elevation below that of the tobacco particle feed means;

a forced air distribution surface having a length extending across the lower portion of said separator chamber substantially from the chamber first end to the chamber second end, said surface including openings permitting the introduction of upwardly directed forced air from underneath the surface and into the separator chamber for the purpose of lifting and separating the tobacco leaf particles;

forced air supply means for directing forced air upwardly through said air distribution surface and into the separator chamber;

means associated with said forced air supply means and said air distribution surface for establishing along the length of said air distribution surface and from said first end of said chamber to said chamber second end, a plurality of upwardly directed air streams with varied velocities with the higher velocity air streams being proximate the separator chamber first end and the lower velocity air streams being proximate the chamber second end, so that the velocity of the respective upwardly directed forced air streams is correlated with the decreasing velocity of the stream of leaf and stem particles propelled across the separator chamber; and means for selectively adjusting the tobacco particle feed velocity and the angular orientation of the fed particle stream with respect to the horizontal;

the velocities of the forced air streams being adjustable independently of the velocity and angular orientation of the particle stream in response to the characteristics of the tobacco particles to provide, for all tobacco particle characteristics, peeling off of a substantial portion of the light leaf particles in an upward direction proximate said first end and projection of the heavier stem particles substantially along a descending path across said chamber to said stem removal means.

2. A classifier as claimed in claim 1 wherein said tobacco particle feed means includes a vaned rotor and wherein said means for selectively adjusting the tobacco particle feed velocity and angular orientation includes:

a variable speed drive for said vaned rotor; and an adjustable deflector plate located immediately downstream of and beneath said vaned rotor.

3. A classifier as claimed in claim 1 wherein said means for establishing a progressively changing velocity of forced air input comprises air pattern screen means including openings sized to produce higher input air stream velocities proximate the separator chamber first end and progressively lower air stream velocities along the length of said air distribution surface, with the slowest air stream velocities being proximate the separator chamber second end.

4. A classifier as claimed in claim 3 wherein said air pattern screen means comprises a frame supported for easy removal and placement in said separation chamber, and screen material fixed on said frame.

5. A classifier as claimed in claim 4 wherein said screen material includes a plurality of zones along the length thereof, and wherein the sizes of the openings in said zones is varied from zone to zone.

6. A classifier as claimed in claim 1 including air diffuser vanes for establishing the multiple streams.

7. A classifier as claimed in claim 6 wherein the highest velocity air stream travels a shorter distance and through a smaller volume than the lower velocity air stream with any intermediate velocity air stream(s) travelling an intermediate distance through an intermediate volume.

8. A classifier as claimed in claim 1 wherein said means for establishing a plurality of air streams provides an air stream velocity of about 800 feet per minute in a first zone proximate said chamber first end, a second air stream velocity of about 450 feet per minute in a second zone intermediate the chamber first and second ends, and a third air stream velocity of about 450 feet per minute in a second zone intermediate the chamber first and second ends, and a third air stream velocity of about 200 feet per minute proximate the chamber second end.

9. A classifier as claimed in claim 1 wherein said separator chamber second end includes an outwardly curved wall (15) above the stem removal means, said curved wall being so curved and so positioned as to approximate the path of the heavier stem particles as they approach the second end to encourage such particles to fall downwardly into said stem removal means without disrupting the smooth flow of particles through the chamber.

10. A classifier as claimed in claim 1 wherein said forced air distribution surface is downwardly inclined from the separator chamber first end to the chamber second end at an angle on the order of about 30° with respect to horizontal.

11. A vertical lift pneumatic classifier for separating light tobacco leaf particles from heavier tobacco stem particles in a single pass of combined tobacco particles across a separation chamber, and being adjustable for use with a full range of tobacco particle sizes and shapes in a threshing system, said classifier comprising:

a vertically extending separator chamber;

a variable speed, vaned rotor located at a first end of said separator chamber for projecting a stream of intermixed light leaf and heavier stem particles across said separator chamber from said first end toward a second end thereof;

a leaf removal duct disposed proximate an upper portion of said separator chamber;

a stem removal chute located at said second end of said separator chamber, and at an elevation below that of the vaned rotor;

a static, planar air distribution screen extending at a downward incline across said separator chamber substantially from the chamber first end to a point near the stem removal chute at the chamber second end at an elevation below said vaned rotor, said screen surface permitting the introduction of forced air therethrough and into the separator chamber for the purpose of lifting and separating the tobacco leaf particles from said stem particles, the openings of said screen being sized to provide greater air velocities near the chamber first end and progressively lower air velocities as the screen extends to the chamber second end;

forced air supply means for directing forced air through said air distribution screen and into the separator chamber;

air diffuser vanes associated with said forced air supply means for establishing multiple streams of inlet forced air, with the highest velocity stream being proximate the separator chamber first end, and with the lowest velocity being proximate the second end of said chamber so that the varied decreasing velocities of the forced air input streams are correlated with the decreasing velocity of the stream of leaf and stem particles propelled across the separator chamber;

whereby the velocity of the fed tobacco particles and the forced air velocities along said air distribution screen are independently adjustable is response to the characteristics of the fed tobacco particles to provide, for all particle characteristics, peeling off of a substantial portion of the light leaf particles in an upward direction proximate said first end and projection of the heavier stem particles substantially along a descending path to said stem removal chute.

12. A classifier as claimed in claim 11 wherein said screen includes a plurality of zones along the length thereof, and wherein the sizes of the openings in said zones are varied from zone to zone.

13. A classifier as claimed in claim 11 wherein the highest velocity stream travels a shorter distance and through a smaller volume than the lowest velocity stream, with any intermediate velocity stream(s) travelling an intermediate distance through an intermediate volume.

14. A classifier as claimed in claim 11 wherein the screen and air diffuser vanes are constructed to encourage a forced air flow velocity proximate the chamber first end that is on the order of four times higher than the forced air flow velocity at the chamber second end.

15. A classifier as claimed in claim 11 wherein said classifier provides an air input stream velocity on the order of about 800 feet per minute in a first zone proximate said chamber first end, a second air input stream velocity of about 450 feet per minute in a second zone intermediate the chamber first and second ends, and a third air input stream velocity of about 200 feet per minute proximate the chamber second end.

16. A classifier as claimed in claim 11 wherein said separator chamber second end includes an outwardly curved wall (15) above the stem removal chute, said curved wall being so curved and so positioned as to approximate the path of the heavier stem particles as they approach the second end to encourage such particles to fall downwardly into said stem removal chute without disrupting the smooth flow of particles through the chamber.

17. A classifier as claimed in claim 11 wherein said air distribution screen is downwardly inclined from the separator chamber first end to the chamber second end at an angle on the order of about 30°.

18. A single pass tobacco particle classifier for separating lighter tobacco leaf particles from heavier tobacco stem particles and comprising:

a separator chamber having opposed ends, an upper portion, and a lower portion;

means for projecting a combined dispersing stream of light tobacco leaf particles and heavier tobacco stem particles in an arc-shaped path across said chamber, from one end toward another second end, with the velocity of said stream decreasing as it approaches the second other end;

means for applying to said combined projected particle stream a plurality of upwardly moving air streams having differing velocities for gently separating lighter tobacco leaf particles from heavier tobacco stem particles in a single pass of said combined particle stream across said air streams;

the higher velocity air streams engaging faster portions of the combined particle streams proximate said one end and across said projected particle stream and the lower velocity air streams engaging slower portions of the combined projected particle stream proximate said second other end and across said projected stream.

19. A single pass tobacco particle classifier as in claim 18 further including tobacco stem particle removing means disposed in the lower portion of said chamber, and wherein said combined stream is directed across said chamber toward said lower portion, said arc-shaped path descending into said removing means.

20. A single pass tobacco particle classifier as in claim 19 wherein said means for applying upwardly moving air streams includes a planar screen means inclined from a higher position proximate said one end to a lower position proximate said lower portion of said second end of said chamber.

21. A single pass tobacco particle classifier as in claim 20 further including means for adjusting the velocity of said combined particle stream and independent means for adjusting the relative velocities of said air streams to accommodate varying shapes and sizes of tobacco particles.

22. A method of separating light tobacco leaf particles from heavier stem particles in a single pass, vertical lift pneumatic classifier including a vertically extending separator chamber having opposite ends, tobacco particle feed means disposed proximate one of said ends of the separator chamber for projecting a stream of intermixed light leaf and heavier stem particles into and across the separator chamber toward the other end thereof at an initial velocity, the stream velocity decreasing as the stream progresses across the chamber, forced air inlet supply means for directing forced air upwardly through and across the length of the separator chamber between said ends, light leaf removal means in an upper portion of said separator chamber and stem removal means in a lower portion of said separator chamber, said method comprising the steps of:

projecting the stream of intermixed particles into and across the separator chamber at a predetermined velocity and angular position;

dividing the inlet forced air directed upwardly into respective high, medium, and low velocity streams, directing the high velocity forced air stream through the projected stream of particles immediately after they enter the separator chamber at said one end, and directing the medium velocity stream through the central portion of the separator chamber and through the medial portion of the stream of particles, and directing the low velocity stream adjacent the other end of the separator chamber and through the stream of particles as they approach the other end of the separator chamber, and thus correlating the high-to-low velocities of the separate air streams with the corresponding decreasing velocities of the stream of intermixed particles being fed across the separator chamber to gently separate the light leaf particles from the heavier stem particles, so that the light leaf particles rise to said light leaf removal means and the stems fall to said stem removal means on a single pass of the intermixed stream across said chamber.

23. A method as in claim 22 wherein the velocity and angular position of the stream of intermixed particles is adjustable, and including the further step of adjusting said velocity and angular positions to furthehr correlate the interaction of the air streams and intermixed particle streams.

24. A method as in claims 22 or 23 wherein the respective velocities of the high, medium and low velocity air sterams are adjustable and including the further step of adjusting said velocities as a function of the size and shape of tobacco particles fed into the chamber to further correlate the particle stream and air stream velocities to gently separate the light leaf particles from heavier stem particles.

25. A method according to claim 22 wherein the pneumatic classifier includes air pattern screen means positioned between the forced air inlet supply means and the stream of intermixed particles being propelled across the separator chamber, said method including the additional step of selecting an air pattern screen having openings of a predetermined size therein to permit a predetermined amount of forced air to pass through the selected screen and through the stream of intermixed particles being projected across the separator chamber.

26. A method for separating various types of light tobacco leaf particles from various types of heavier tobacco stem particles in a single pass across a separating air stream including the steps of:

combining said particles in a particle stream;

projecting said stream in an arc-shaped path;

projecting at least three independent streams of air moving at different velocities transversely across said path and through said projected combined particle stream with a higher velocity air stream engaging said projected combined particle stream at an upstream position thereof, corresponding to a high particle stream velocity, and sucessively lower velocity air streams engaging said projected particle streams at downstream positions thereof corresponding to successively lower particle stream velocities; and independently adjusting the velocity of the particle stream and of the at least three separate air streams to correlate all said respective velocities as a function of the particular type of tobacco particles to be separated.

27. A vertical lift pneumatic classifier for separating light tobacco leaf particles from heavier tobacco stem particles in a combined stream of particles, and being adjustable for use wth a full range of fed tobacco particle sizes and shapes in a threshing system, said classifier comprising:

a vertically extending separator chamber;

tobacco particle feed means located at a first end of said separator chamber for projecting a stream of intermixed light leaf and heavier stem particles across said separator chamber from one end thereof toward another;

leaf removal means disposed proximate an upper portion of said separator chamber;

stem removal means located at a second opposite end of said separator chamber, opposite said tobacco particle feed means, and at an elevation below that of the tobacco particle feed means;

a forced air distribution surface extending across the lower portion of said separator chamber substantially from the chamber first end to the chamber second end, said surface including openings permitting the introduction of upwardly directed forced air from underneath the surface and into the separator chamber for the purpose of lifting and separating the tobacco leaf particles;

forced air supply means for directing forced air upwardly through said air distribution surface and into the separator chamber;

means associated with said forced air supply means and said air distribution surface for establishing along the length of said air distribution surface from said first end of said chamber to said second end, a plurality of upwardly directed air streams having varying velocities with the higher velocity air streams being proximate the separator chamber first end and the lower velocity air streams being proximate the chamber second end, so that the velocity of the respective upwardly directed forced air streams is correlated with the decreasing velocity of the stream of leaf and stem particles projected across the separator chamber; and means for selectively adjusting the tobacco particle feed velocity and the angular orientation of the fed particle stream with respect to the horizontal;

the progressively changing velocities of the forced air streams being adjustable independently of the velocity and angular orientation of the projected particle stream in response to the characteristics of the tobacco particles to provide, for all tobacco particle characteristics, peeling off of a substantial portion of the light leaf particles in an upward direction proximate said first end and projection of the heavier stem particles substantially along a descending path across said chamber to said stem removal means.

28. A vertical lift pneumatic classifier for separating light tobacco leaf particles from heavier tobacco stem particles in a combined stream of particles, and being adjustable for use with a full range of tobacco particle sizes and shapes, said classifier comprising:

a vertically extending separator chamber;

a variable speed, vaned rotor located at a first end of said separator chamber for projecting a stream of intermixed light leaf and heavier stem particles across said separator chamber from said first end toward a second end thereof;

a leaf removal duct disposed proximate an upper portion of said separator chamber;

a stem removal chute located at said second end of said separator chamber, and at an elevation below that of the vaned rotor;

a static, planar air distribution screen extending at a downward incline across said separator chamber substantially from the chamber first end to a point near the stem removal chute at the chamber second end at an elevation below said vaned rotor, said screen surface pemitting the introduction of forced air therethrough and into the separator chamber for the purpose of lifting and separating the tobacco leaf particles from said stem particles, the openings of said screen being sized to provide greater air velocities near the chamber first end and progressively lower air velocities as the screen extends to the chamber second end;

forced air supply means for directing forced air through said air distribution screen and into the separator chamber;

air diffuser vanes associated with said forced air supply means for establishing multiple streams of inlet forced air, with the highest velocity stream being proximate the chamber first end, so that the velocities of the forced air input are correlated with the decreasing velocity of the stream of leaf and stem particles projected across the separator chamber;

whereby the velocity of the fed tobacco particles and the forced air velocities along said air distribution screen are independently adjustable in response to the characteristics of the fed tobacco particles to provide, for all particle characteristics, peeling off of a substantial portion of the light leaf particles in an upward direction proximate said first end and projection of the heavier stem particles substantially along a descending path to said stem removal chute.

29. A tobacco particle classifier for separating lighter tobacco leaf particles from heavier tobacco stem particles in a combined stream of particles and comprising:

a separator chamber having opposed ends, an upper portion, and a lower portion;

means for projecting a combined stream of light tobacco leaf particles and heavier tobacco stem particles in an arc-shaped path across said chamber, from one end toward another second end, with the velocity of said stream decreasing as it approaches the second end, means below said particle stream for applying to and across said projected combined particle stream a plurality of upwardly moving air streams having differing velocities for gently separating lighter tobacco leaf particles from heavier tobacco stem particles;

the higher velocity air streams engaging faster upstream portions of the projected combined particle stream thereacross and the lower velocity air streams engaging slower downstream portions of the projected combined particle stream thereacross.

30. A method of separating light tobacco leaf particles from heavier stem particles in a combined stream of particles in a vertical lift pneumatic classifier including a vertically extending separator chamber having opposite ends, tobacco particle feed means disposed proximate one of said ends of the separator chamber for projecting a stream of intermixed light leaf and heavier stem particles into and across the separator chamber toward the other end thereof at an initial velocity, the stream velocity decreasing as the stream progresses across the chamber, forced air inlet supply means for directing forced air upwardly through and across the length of the separator chamber between said ends, light leaf removal means in the upper portion of said separator chamber and stem removal means in the lower portion of said separator chamber, said method comprising the steps of:

projecting the stream of intermixed particles into and across the separator chamber at a said initial velocity and predetermined angular position;

dividing the inlet forced air directed upwardly into respective high, medium, and low velocity streams, directing the high velocity forced air stream through the projected stream of particles immediately after they enter the separator chamber at said one end, directing the medium velocity stream through the central portion of the separator chamber and through the medial portion of the projected stream of particles, and directing the low velocity stream adjacent the other end of the separator chamber and through the projected stream of particles as they approach the other end of the separator chamber, and thus correlating the high-to-low velocities of the separate air streams with the corresponding decreasing velocities of the projected stream of intermixed particles being fed across the separator chamber to gently separate the light leaf particles from the heavier stem particles, so that the light leaf particles rise to said light leaf removal means and the stems fall to said stem removal means.

31. A method for separating various types of light tobacco leaf particles from various types of heavier tobacco stem particles in a combined stream of particles including the steps of:

combining said particles in a particle stream;

projecting said stream in an arc-shaped path;

projecting at least three independent streams of air moving at different velocities transversely across said path and through said combined particle stream with a higher velocity air stream engaging said projected combined particle stream at an upstream position thereof, corresponding to a high particle stream velocity, and successively lower velocity air streams engaging said particle stream at downstream positions thereof corresponding to successively lower particle stream velocities to separate leaf particles from stem particles; and independently adjusting the velocity of the particle stream and of the at least three separate air streams to correlate all said respective velocities as a function of the particular type of tobacco particles to be separated.

32. A method as in claim 31 including the further step of depositing heavier tobacco stem particles on an inclined screen through which said independent streams of air pass, wherein said heavier tobacco stem particles move along said screen toward stem removal means.

33. A particle classifier for separating lighter particles from heavier particles in a single pass of a stream of combined particles across a separator chamber and comprising:

a separator chamber having opposed ends, an upper portion, and a lower portion;

means for projecting a combined stream of lighter particles and heavier particles in an arc-shaped path across said chamber, from one end toward another second end, with the velocity of said stream decreasing as it approaches the second other end, means for applying to said projected particle stream a plurality of upwardly moving air streams having differing velocities for gently separating lighter particles from heavier particles in a single pass of said projected particle stream across said air streams;

the higher velocity air streams engaging faster portions of the projected combined particle stream proximate said one end and across said projected stream and the lower velocity air streams engaging slower downstream portions of the projected combined particle stream proximate said second end and across said projected stream.

34. A particle classifier for separating lighter particles from heavier particles in a stream of combined particles in a separator chamber and comprising:

a separator chamber having opposed ends, an upper portion, and a lower portion;

means for projecting a combined stream of lighter particles and heavier particles in an arc-shaped path across said chamber, from one end toward another second end, with the velocity of said stream decreasing as it approaches the second other end, means for applying to said projected particle stream a plurality of upwardly moving air streams having differing velocities for gently separating lighter particles from heavier particles in a single pass of said projected particle stream across said air streams;

the higher velocity air streams engaging faster portions of the projected combined particle stream proximate said one end and across said projected stream and the lower velocity air streams engaging slower downstream portions of the projected particle stream proximate said second end and across said downstream portions of said projected stream.

* * * * *